US012379142B2

(12) United States Patent
Moharreri et al.

(10) Patent No.: US 12,379,142 B2
(45) Date of Patent: Aug. 5, 2025

(54) ACTIVE MANAGEMENT OF REFRIGERANT CHARGE BETWEEN CONDENSER LOOPS

(71) Applicant: Atieva, Inc., Newark, CA (US)

(72) Inventors: Arash Moharreri, Fremont, CA (US); Balaji Maniam, Fremont, CA (US); Sai Rajeev Devaragudi, Fremont, CA (US)

(73) Assignee: Atieva, Inc., Newark, CA (US)

( * ) Notice: Subject to any disclaimer, the term of this patent is extended or adjusted under 35 U.S.C. 154(b) by 229 days.

(21) Appl. No.: 18/194,300

(22) Filed: Mar. 31, 2023

(65) Prior Publication Data

US 2024/0044559 A1 Feb. 8, 2024

Related U.S. Application Data

(60) Provisional application No. 63/370,202, filed on Aug. 2, 2022.

(51) Int. Cl.

| | |
|---|---|
| ***F25B 45/00*** | (2006.01) |
| ***F25B 6/02*** | (2006.01) |
| ***F25B 39/04*** | (2006.01) |

(52) U.S. Cl.

CPC ..... *F25B 45/00* (2013.01); *F25B 39/04* (2013.01); *F25B 6/02* (2013.01); *F25B 2600/05* (2013.01)

(58) Field of Classification Search

CPC .. F25B 45/00; F25B 39/04; F25B 6/02; F25B 2600/05; F25B 41/20; F25B 6/04

See application file for complete search history.

(56) References Cited

U.S. PATENT DOCUMENTS

| | | | | |
|---|---|---|---|---|
| 3,791,165 | A * | 2/1974 | Honnold, Jr. | F25B 45/00 62/149 |
| 5,507,337 | A | 4/1996 | Rafalovich et al. | |
| 10,150,383 | B2 | 12/2018 | Gauthier et al. | |
| 2003/0051489 | A1 * | 3/2003 | Cho | F25B 6/02 62/502 |

(Continued)

FOREIGN PATENT DOCUMENTS

| | | | | |
|---|---|---|---|---|
| CN | 105910323 | A * | 8/2016 | F25B 41/20 |
| CN | 108106035 | A | 6/2018 | |

(Continued)

OTHER PUBLICATIONS

International Search Report and Written Opinion for PCT Application No. PCT/US2023/071332, mailed on Nov. 21, 2023, 13 pages.

*Primary Examiner* — Kun Kai Ma

(74) *Attorney, Agent, or Firm* — Brake Hughes Bellermann LLP

(57) ABSTRACT

A refrigeration system comprises: an evaporator having an evaporator inlet and an evaporator outlet; a compressor having (i) a compressor outlet, and (ii) a compressor inlet coupled to the evaporator outlet; a first condenser loop coupled between the compressor outlet and the evaporator inlet, the first condenser loop comprising: a first inlet valve, a first condenser, and a first redistribution valve coupling the first condenser loop to the compressor inlet; and a second condenser loop coupled between the compressor outlet and the evaporator inlet, the second condenser loop comprising: a second inlet valve, a second condenser, and a second redistribution valve coupling the second condenser loop to the compressor inlet.

26 Claims, 7 Drawing Sheets

(56) References Cited

U.S. PATENT DOCUMENTS

| | | | |
|---|---|---|---|
| 2015/0059367 | A1 | 3/2015 | Emo et al. |
| 2016/0107502 | A1 | 4/2016 | Johnston |
| 2017/0088007 | A1 | 3/2017 | Melendez et al. |
| 2017/0229746 | A1 | 8/2017 | Rawlinson et al. |
| 2019/0070924 | A1 | 3/2019 | Mancini et al. |
| 2019/0113245 | A1 | 4/2019 | Usilton |
| 2019/0381861 | A1 | 12/2019 | Maniam et al. |
| 2020/0132204 | A1 | 4/2020 | Krost et al. |
| 2020/0309394 | A1 | 10/2020 | Blanton |
| 2022/0128283 | A1 | 4/2022 | Hinderliter |

FOREIGN PATENT DOCUMENTS

| | | | | | |
|---|---|---|---|---|---|
| EP | 2136164 | B1 * | 9/2018 | ..... | F25B 45/00 |
| WO | WO-2017221396 | A1 * | 12/2017 | ..... | F25B 1/00 |
| WO | WO-2018047331 | A1 * | 3/2018 | ..... | F24F 5/00 |
| WO | WO-2019043768 | A1 * | 3/2019 | ..... | F25B 39/04 |

* cited by examiner

ACTIVE MANAGEMENT OF REFRIGERANT CHARGE BETWEEN CONDENSER LOOPS

CROSS-REFERENCE TO RELATED APPLICATION

This application claims benefit, under 35 U.S.C. § 119, of U.S. Provisional Patent Application No. 63/370,202, filed on Aug. 2, 2022, entitled "ACTIVE MANAGEMENT OF REFRIGERANT CHARGE BETWEEN CONDENSER LOOPS," the disclosure of which is incorporated by reference herein in its entirety.

TECHNICAL FIELD

This document relates to active management of refrigerant charge between multiple condenser loops.

BACKGROUND

Automotive manufacturers continue to develop their thermal systems to meet changing demands in terms of increased efficiency, increased capacity, or smaller size. For example, increasing efficiency can involve improving or optimizing the way the thermal system's performance affects range of the vehicle. As another example, increasing capacity can involve designing the thermal system to handle significant thermal load from components such as a battery pack, or to provide heating of the cabin. In prior approaches, refrigerant in a thermal system has been managed using accumulators or charge compensators, wherein a reservoir stores the extra refrigerant charge. The full refrigerant capacity of the reservoir can be moved in or out of the reservoir based on operating mode.

SUMMARY

In a first aspect, a refrigeration system comprises: an evaporator having an evaporator inlet and an evaporator outlet; a compressor having (i) a compressor outlet, and (ii) a compressor inlet coupled to the evaporator outlet; a first condenser loop coupled between the compressor outlet and the evaporator inlet, the first condenser loop comprising: a first inlet valve, a first condenser, and a first redistribution valve coupling the first condenser loop to the compressor inlet; and a second condenser loop coupled between the compressor outlet and the evaporator inlet, the second condenser loop comprising: a second inlet valve, a second condenser, and a second redistribution valve coupling the second condenser loop to the compressor inlet.

Implementations can include any or all of the following features. The first redistribution valve couples a point on the first condenser loop before the first condenser to the compressor inlet. The first condenser loop further comprises a third condenser. The third condenser and the first condenser are coupled in series in the first condenser loop. The first redistribution valve couples a point on the first condenser loop between the third condenser and the first condenser to the compressor inlet. The refrigeration system further comprises a third redistribution valve that couples a point on the first condenser loop after the first and third condensers to the compressor inlet. The third condenser and the first condenser are coupled in parallel in the first condenser loop. The first redistribution valve couples a point on the first condenser loop before the first and third condensers to the compressor inlet. The refrigeration system further comprises a third redistribution valve that couples a point on the first condenser loop after the first and third condensers to the compressor inlet. The first redistribution valve couples a point on the first condenser loop after the first condenser to the compressor inlet. The refrigeration system further comprises a sensor to detect an undercharge condition or an overcharge condition in the refrigeration system. The refrigeration system further comprises a third condenser loop coupled between the compressor outlet and the evaporator inlet, the third condenser loop comprising: a third inlet valve, a third condenser, and a third redistribution valve coupling the third condenser loop to the compressor inlet.

In a second aspect, a method comprises: activating a first condenser loop in a refrigeration system, wherein a second condenser loop is presently not active; monitoring sensor output in the refrigeration system indicating whether an undercharge condition or an overcharge condition exists in the refrigeration system; and managing refrigerant charge distribution between the first and second condenser loops based on whether the undercharge condition or the overcharge condition exists in the refrigeration system.

Implementations can include any or all of the following features. Monitoring the sensor output for whether the undercharge condition exists in the refrigeration system comprises monitoring at least one of evaporator outlet pressure, evaporator outlet temperature, or opening of expansion valve coupled to an inlet of an evaporator in the refrigeration system. In response to the sensor output indicating that the undercharge condition exists in the refrigeration system, managing the refrigerant charge distribution comprises opening a redistribution valve of the second condenser loop. In response to the sensor output indicating that the undercharge condition exists in the refrigeration system, managing the refrigerant charge distribution further comprises opening an inlet valve of the second condenser loop. Monitoring the sensor output for whether the overcharge condition exists in the refrigeration system comprises monitoring at least one of subcooling, compressor discharge pressure, or suction superheat. Subcooling is monitored, and wherein monitoring subcooling comprises detecting pressure and temperature at an evaporator outlet in the refrigeration system. In response to the sensor output indicating that the overcharge condition exists in the refrigeration system, managing the refrigerant charge distribution comprises opening a redistribution valve of the second condenser loop. In response to the sensor output indicating that the overcharge condition exists in the refrigeration system, managing the refrigerant charge distribution further comprises activating a heat-removing mechanism of the second condenser loop. The activation of the first condenser loop, the monitoring of the sensor output, and the management of the refrigerant charge distribution are performed while the refrigeration system is operating in a cooling mode. The cooling mode comprises that a first inlet valve of the first condenser loop is open, the method further comprising, at a beginning of the cooling mode, temporarily opening a second inlet valve of the second condenser loop, an outlet valve of the second condenser loop, and a redistribution valve of the second condenser loop. The activation of the first condenser loop, the monitoring of the sensor output, and the management of the refrigerant charge distribution are performed while the refrigeration system is operating in a heating mode. The heating mode comprises that a second inlet valve of the second condenser loop, and an outlet valve of the second condenser loop, are open. The activation of the first condenser loop, the monitoring of the sensor output, and the management of the refrigerant charge distribution are performed while the refrigeration system is operating in a combined cooling and heating mode. The method further comprises, in response to heat rejection through the first condenser loop exceeding a threshold, at least partially opening each of: (i) a first inlet valve of the first condenser loop, (ii) a second inlet valve of the second condenser loop, and (iii) an outlet valve of the second condenser loop.

BRIEF DESCRIPTION OF DRAWINGS

Like reference symbols in the various drawings indicate like elements.

DETAILED DESCRIPTION

This document describes examples of systems and techniques that actively manage refrigerant charge between multiple condenser loops. In some implementations, a network of refrigerant control valves and sensors are used to move refrigerant charge between different loops of the refrigeration system. Based on the operating mode of the system, different amounts of refrigerant may be needed in the operating part of the system to obtain optimal performance and efficiency. Quantities such as superheat and subcooling can be monitored using sensors in the system to determine if the operating part of the system is undercharged, normal, or overcharged. Based on the existing status, refrigerant control valves are operated to move the required amount of the refrigerant in/out of the operating part of the system.

Advantages of the present subject matter can include one or more of the following. A more compact refrigeration system can be designed. The need for an accumulator or a refrigerant reservoir in the refrigeration loop can be eliminated. The capacity and efficiency of a refrigeration system in various operating conditions can be improved/optimized. For example, a refrigeration system can be provided that operates with an optimal amount of refrigerant charge at each operating condition. This feature is not feasible with conventional systems since the entire capacity of the refrigerant reservoir is moved between different loops and capacity and efficiency can only be optimized for some of the operating modes.

Examples described herein refer to coupling of two or more components, or connecting them to each other. Unless otherwise indicated, coupling of components or connecting them together means to enable flow of a fluid in one or more directions between the components. The fluid flow can include, but is not limited to, passage of refrigerant in liquid, two-phase, and/or gaseous form.

Examples described herein refer to a top, bottom, front, or rear. These and similar expressions identify things or aspects in a relative way based on an express or arbitrary notion of perspective. That is, these terms are illustrative only, used for purposes of explanation, and do not necessarily indicate the only possible position, direction, and so on. As used herein, the terms inlet and outlet used with any component can reflect the way the component is installed and do not necessarily indicate that the component has, or does not have, any particular structure.

Figure 1:
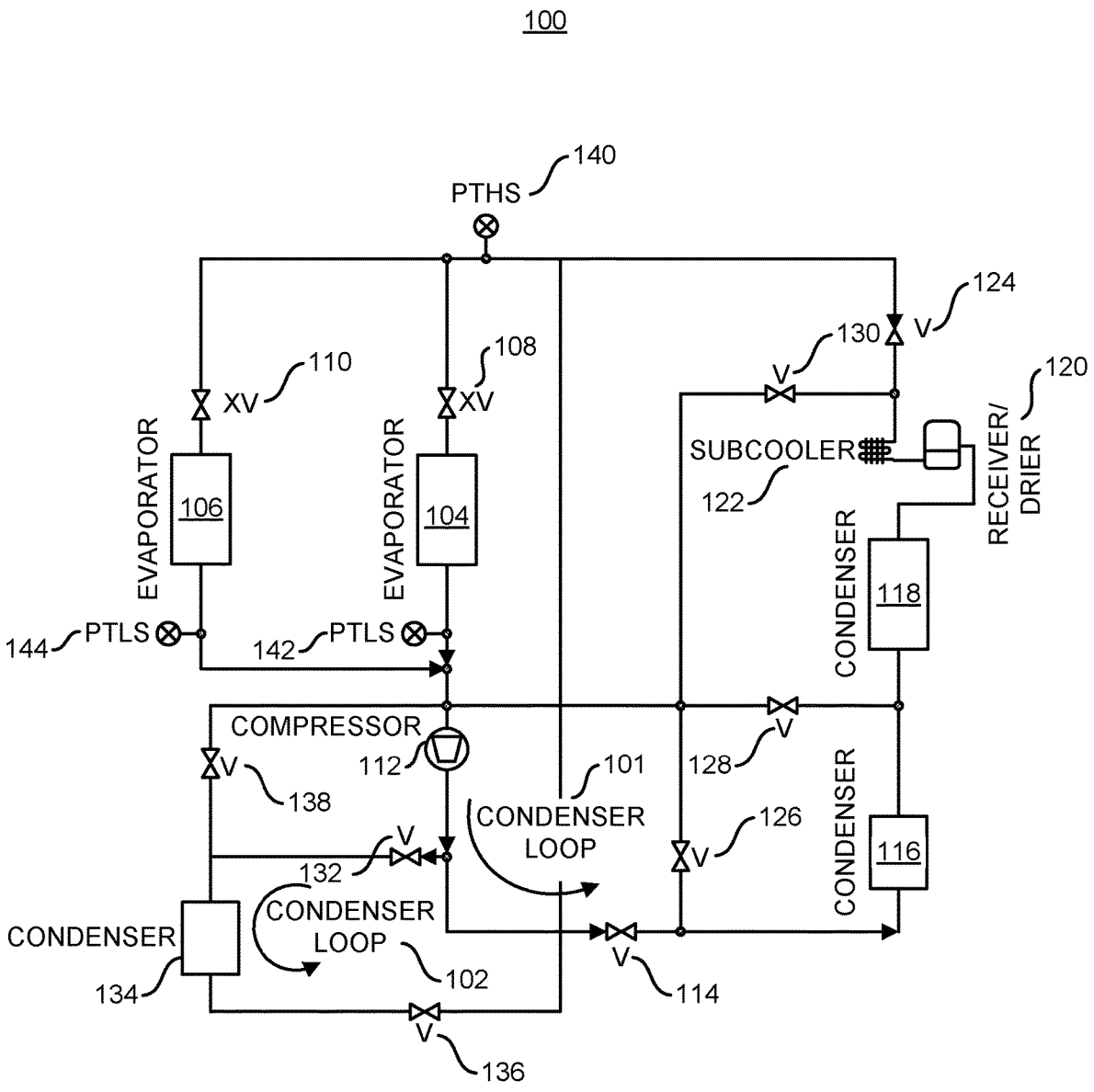
FIGS. 1-4 show examples of refrigeration systems that can actively manage refrigerant charge between multiple condenser loops.
Figure 2:
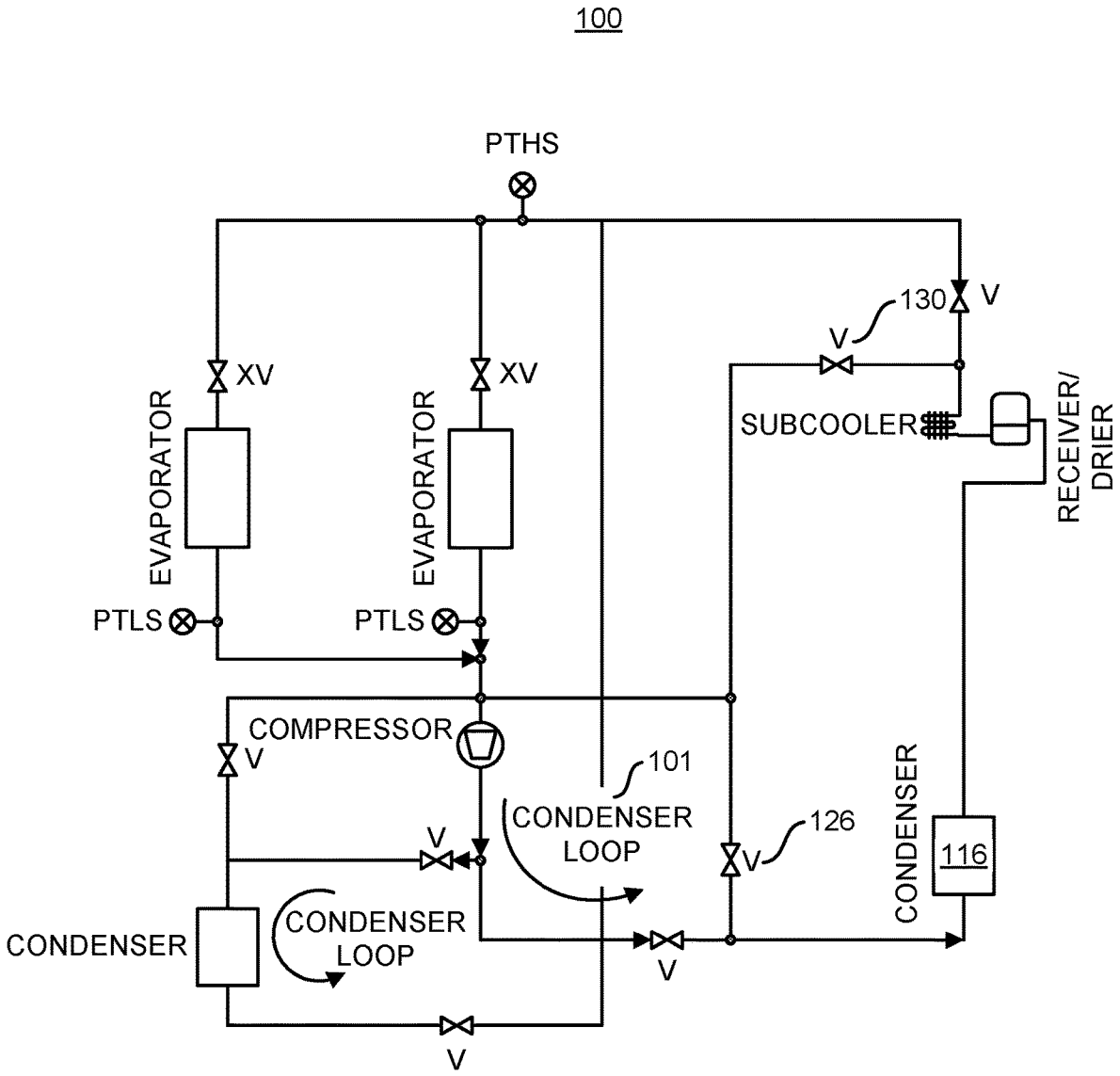
Figure 3:
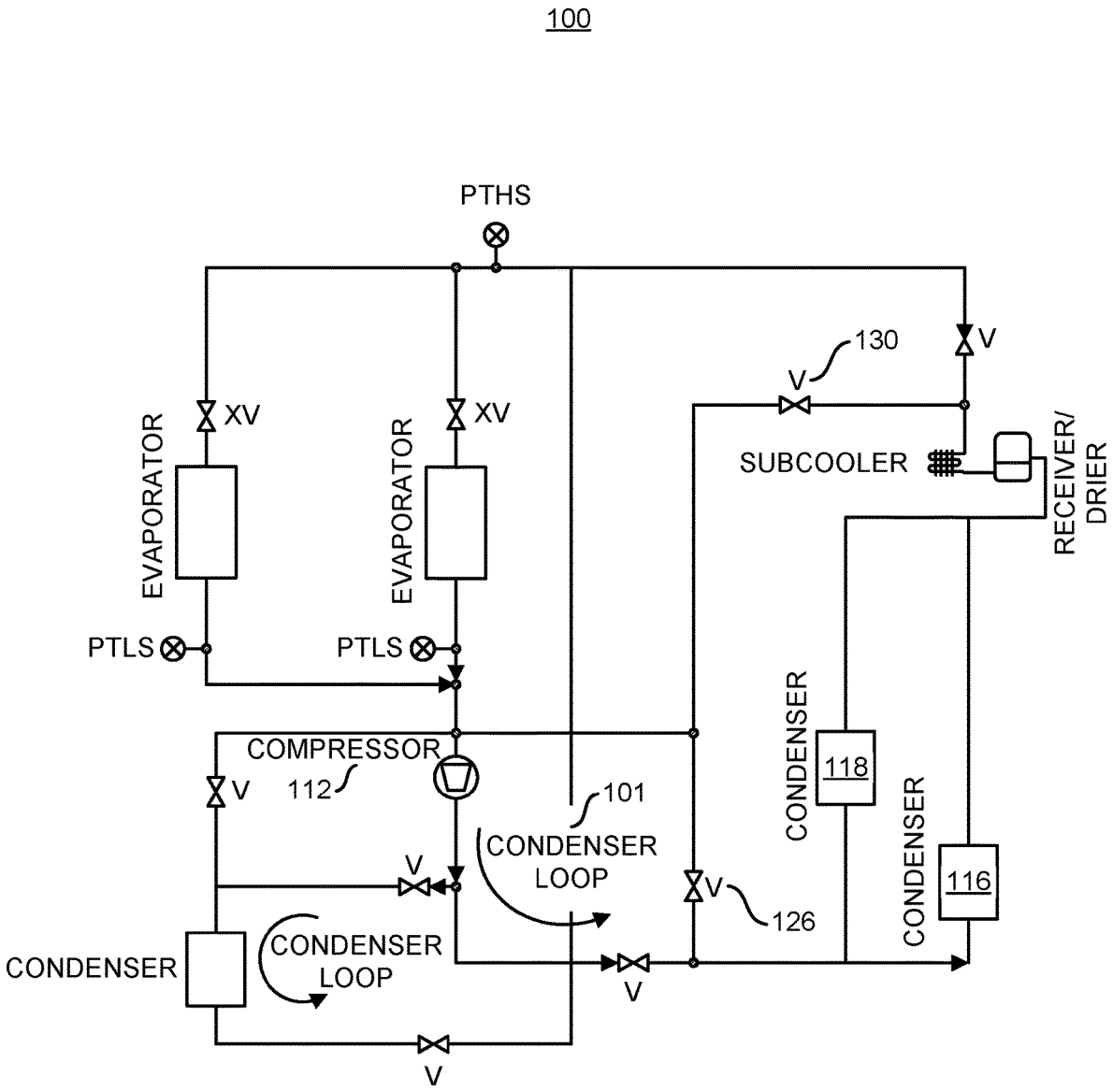

FIGS. 1-3 show examples of a refrigeration system 100 that can actively manage refrigerant charge between condenser loops 101 and 102. The refrigeration system 100 or any component(s) thereof can be used with one or more other examples described elsewhere herein.

The refrigeration system 100 can include one or more evaporators. Here, the refrigeration system 100 includes evaporators 104 and 106. Each of the evaporators 104 and 106 is a device that can allow refrigerant to evaporate (vaporize) from a liquid state to a gaseous state. Any type of evaporator compatible with the refrigerant of the refrigeration system 100 can be used. The evaporators 104 and 106 can be of the same type, or can be of different types. The evaporators 104 and 106 can have the same capacity as each other, or can have different capacities. Each of the evaporators 104 and 106 has an inlet and an outlet. Here, the inlets of the evaporators 104 and 106 are oriented toward the top, and the outlets toward the bottom, of the drawing.

One or more expansion valves can be used in the refrigeration system 100, including, but not limited to, in connection with the evaporator 104 and/or 106. For example, an expansion valve 108 is here positioned at the inlet of the evaporator 104. As another example, an expansion valve 110 is here positioned at the inlet of the evaporator 106. Other approaches can be used.

The refrigeration system 100 can include a compressor 112. The compressor 112 is a device that can increase the pressure of a gas (e.g., refrigerant). Any type of compressor compatible with the refrigerant of the refrigeration system 100 can be used. The compressor 112 has an inlet (sometimes referred to as a suction side) and an outlet (sometimes referred to as a discharge side). Here, the inlet of the compressor 112 is oriented toward the top of the drawing and the outlet is oriented toward the bottom of the drawing. The inlet of the compressor 112 is coupled to the respective outlets of the evaporators 104 and 106.

The condenser loop 101 includes an inlet valve 114. Any type of valve compatible with the refrigerant of the refrigeration system 100 can be used. Here, the inlet valve 114 is coupled to the outlet of the compressor 112. The inlet valve 114 can be used in managing refrigerant charge distribution in the refrigeration system 100, for example as described below.

The condenser loop 101 can include one or more condensers. A condenser is a device that condenses substance in a gaseous state into a liquid state. Any type of condenser compatible with the refrigerant of the refrigeration system 100 can be used. Here, the condenser loop 101 includes condensers 116 and 118. The condensers 116 and 118 can be of the same type, or can be of different types. The condensers 116 and 118 can have the same capacity as each other, or can have different capacities. Here, the condensers 116 and 118 are arranged in series in the condenser loop 101, with the condenser 116 coupled to the inlet valve 114.

The condenser loop 101 can include one or more filters. In some implementations, the condenser loop 101 includes a receiver/drier, which term as used herein can include one or more of a receiver, a drier, or a combined receiver and drier. The receiver/drier can remove particles or other debris, or moisture, from the refrigerant, and separate liquid refrigerant from gaseous refrigerant for further subcooling. Any type of receiver/drier compatible with the refrigerant of the refrigeration system 100 can be used. For example, a receiver/drier 120 is coupled after the condenser 118.

The condenser loop 101 can include one or more components to bring refrigerant below its saturation temperature. In some implementations, the condenser loop 101 includes a subcooler that can bring the refrigerant into liquid form. Any type of subcooler compatible with the refrigerant of the refrigeration system 100 can be used. For example, a subcooler 122 is coupled after the receiver/drier 120.

The condenser loop 101 can include one or more check valves or one-way valves, such as a shut off valve with minimal or no leakage in the reverse direction, or any valve that is able to prevent the flow of refrigerant in the reverse direction. Any type of valve compatible with the refrigerant of the refrigeration system 100 that can prevent reverse flow of the refrigerant can be used. In some implementations, a check valve 124 is coupled after the subcooler 122. For example, the check valve 124 can be coupled to the inlet of the evaporator 104 and/or 106 (e.g., before the expansion valve 108 or 110, respectively).

The refrigeration system 100 can include one or more redistribution valves for use in managing refrigerant charge distribution. Any type of valve compatible with the refrigerant of the refrigeration system 100 can be used. In some implementations, a redistribution valve 126 can be included in the condenser loop 101. For example, the redistribution valve 126 couples a point on the condenser loop 101 before the condenser 116 to the inlet of the compressor 112. In some implementations, a redistribution valve 128 can be included in the condenser loop 101. For example, the redistribution valve 128 couples a point on the condenser loop 101, between the condensers 116 and 118, to the inlet of the compressor 112. In some implementations, a redistribution valve 130 can be included in the condenser loop 101. The redistribution valve 130 can couple a point on the condenser loop 101, after the condensers 116 and 118, to the inlet of the compressor 112. For example, the redistribution valve 130 can be coupled after the subcooler 122. Where possible, multiple valves can be combined as a single valve. For example, in refrigeration system 100, valve 124 and valve 130 can be combined as a 3-way valve. Similarly in refrigeration system 100, valve 114, valve 132, and valve 126/128/130 may be combined in multiple ways to reduce the number of valves to accomplish the same function. In some designs, the valves may have more than two (inlet/outlet) ports. Other approaches can be used.

Turning now to the condenser loop 102, it includes an inlet valve 132. Any type of valve compatible with the refrigerant of the refrigeration system 100 can be used. Here, the inlet valve 132 is coupled to the outlet of the compressor 112. The inlet valve 132 can be used in managing refrigerant charge distribution in the refrigeration system 100, for example as described below.

The condenser loop 102 can include one or more condensers. Any type of condenser compatible with the refrigerant of the refrigeration system 100 can be used. Here, the condenser loop 102 includes a condenser 134 coupled to the inlet valve 132.

The condenser loop 102 can include an exit valve. Any type of valve compatible with the refrigerant of the refrigeration system 100 can be used. Here, an exit valve 136 is coupled after the condenser 134. For example, the exit valve 136 can be coupled to the inlet of the evaporator 104 and/or 106. The exit valve 136 can be used in managing refrigerant charge distribution in the refrigeration system 100, for example as described below.

In some implementations, a redistribution valve 138 can be included in the condenser loop 102. For example, the redistribution valve 138 couples a point on the condenser loop 102 before the condenser 134 to the inlet of the compressor 112. Other approaches can be used.

The refrigeration system 100 can include one or more sensors. The sensor(s) can detect an undercharge condition and/or an overcharge condition in the refrigeration system 100. In some implementations, a sensor 140 can be positioned at the respective ends of the condenser loops 101 and 102. The sensor 140 can represent the refrigerant pressure and/or temperature at the high-pressure side of the refrigeration system. For example, the sensor 140 can be coupled to the inlet of the evaporator 104 and/or 106 (e.g., before the expansion valve 108 or 110, respectively). In some implementations, a sensor 142 can be positioned at the outlet of the evaporator 104. In some implementations, a sensor 144 can be positioned at the outlet of the evaporator 106. At least one of the sensors 142-144 can represent the pressure and/or temperature at the low-pressure side of the refrigeration system. The sensors 140 and 142/144 can be the high-pressure and low-pressure sides, respectively, of the same pressure-temperature refrigerant sensor. In some implementations, a sensor can be positioned at the inlet of the compressor 112.

In some implementations, a control system monitors evaporator outlet pressure, temperature, and/or the opening (or closing) of the expansion valve(s). For example, the control system can take into account calculated superheat, the opening of an expansion valve, and prior characterizations of the refrigeration system 100, in detecting that an undercharge condition exists (e.g., that at least one active condenser loop does not have a sufficient, or optimal, amount of refrigerant). In response to detection of the undercharge condition, one or more redistribution valves of the inactive condenser loop(s) can be opened. This can couple the inactive condenser loop(s) to the inlet (e.g., low pressure suction) of the compressor 112. In some implementations, when the condenser loop 102 is active and the condenser loop 101 is inactive, refrigerant charge distribution can be managed by opening one or more of the redistribution valves 126, 128, or 130. For example, the redistribution valve 126 can provide that refrigerant gas is connected to compressor suction. As another example, the redistribution valve 128 can provide that a two-phase state of refrigerant is connected to compressor suction. As another example, the redistribution valve 130 can provide that refrigerant liquid is connected to compressor suction. The redistribution valve(s) 126, 128, and/or 130 can be opened or restricted appropriately so that a controlled rate of refrigerant charge is moved between the condenser loops. The refrigerant charge can be terminated in response to the control system determining that the active condenser loop is operating normally. In some implementations, when the condenser loop 102 is active and the condenser loop 101 is inactive, the inlet valve 114 can be opened to transfer refrigerant (gas) to aid the management of refrigerant charge distribution. In some implementations, when the condenser loop 101 is active and the condenser loop 102 is inactive, the redistribution valve 138 can be opened or restricted appropriately so that a controlled rate of refrigerant charge is moved between the condenser loops. If appropriate pressure difference between a condenser (e.g., the condenser 116) and compressor suction is not available to drive fluid into compressor suction, the expansion valve opening can be reduced to further decrease compressor suction pressure temporarily to allow flowing of the refrigerant in the desired direction. Other approaches can be used.

In some implementations, the control system can take into account subcooling, compressor discharge pressure, and/or suction superheat, in detecting that an overcharge condition exists (e.g., that at least one active condenser loop has too much, or more than an optimal amount of, refrigerant). For example, subcooling can be calculated using pressure and temperature signals from a pressure-temperature sensor (e.g., the sensor 140). In response to detection of the overcharge condition, the inlet valve of one or more inactive condenser loops can be opened at least partially. For example, this can allow refrigerant to be removed from the active condenser loop(s) and stored in the inactive condenser loop(s). During this process, a compressor duty cycle can be temporarily adjusted to reduce pressure difference between active and inactive loops in order to move the refrigerant in a controlled manner. In some implementations, a heat removal mechanism of the inactive condenser loop can be activated as part of managing the refrigerant charge distribution for the overcharge condition. Lowering the pressure of, and/or cooling, the refrigerant in the inactive condenser loop can aid the refrigerant charge distribution. For example, a secondary fluid (e.g., air or liquid) can be run over/through the condenser 116, or a separate heat exchanger can be used. Other approaches can be used.

FIG. 2 shows another example involving some components of the refrigeration system 100 in FIG. 1. Some aspects are identical or similar and will not be described in detail. Here, the refrigeration system 100 does not include the condenser 118. As such, the condenser loop 101 here has only one condenser, the condenser 116. The redistribution valve 128 can be omitted. For example, the condenser loop 101 can here have the redistribution valve 126 and/or 130. Other approaches can be used.

FIG. 3 shows another example involving some components of the refrigeration system 100 in FIG. 1. Some aspects are identical or similar and will not be described in detail. Here, the refrigeration system 100 has the condenser 118 coupled in parallel with the condenser 116. The redistribution valve 128 can be omitted. In some implementations, the condenser loop 101 can here have the redistribution valve 126 and/or 130. For example, the redistribution valve 126 can couple a point on the condenser loop 101 before the condensers 116 and 118 to the inlet of the compressor 112. As another example, the redistribution valve 130 can couple a point on the condenser loop 101 after the condensers 116 and 118 to the inlet of the compressor 112. Other approaches can be used.

Figure 4:
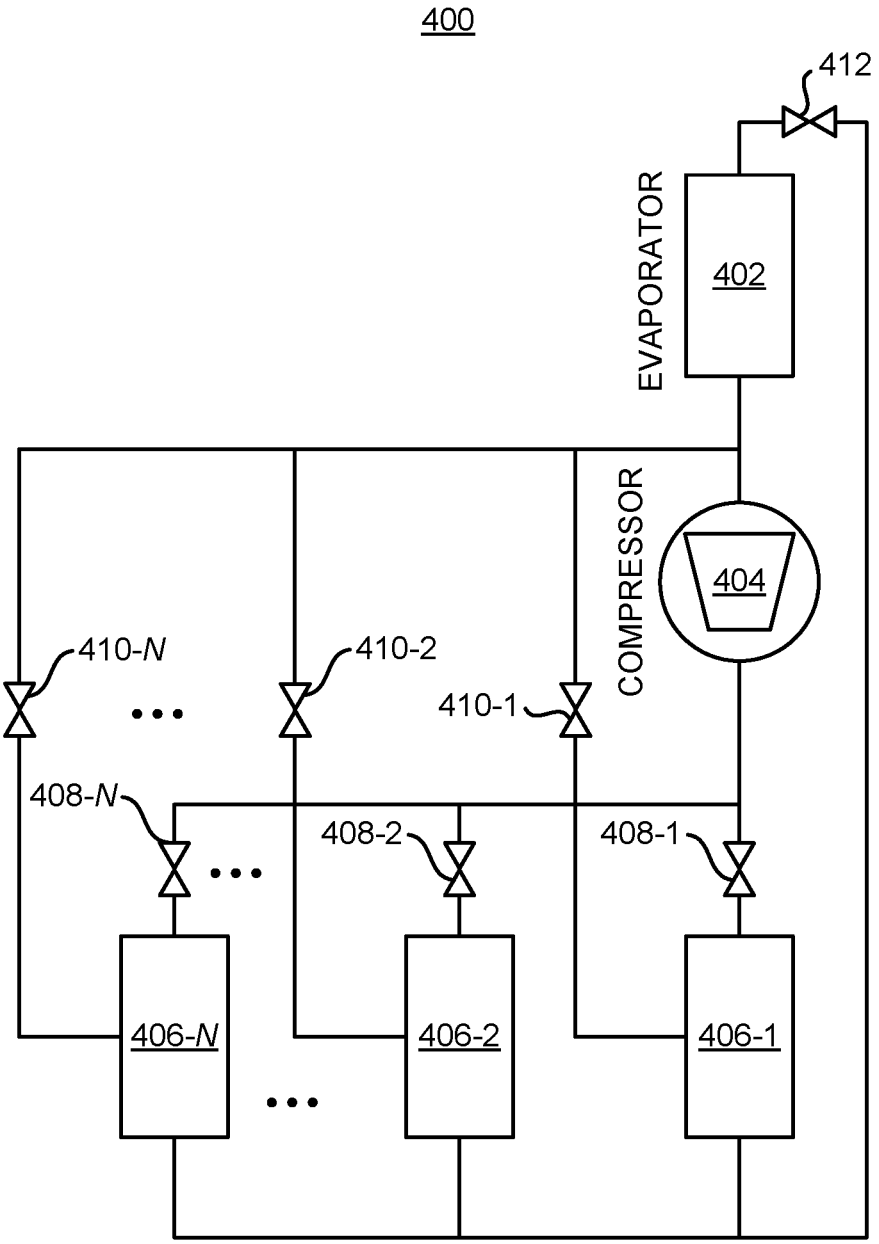

FIG. 4 shows an example of a refrigeration system 400 that can actively manage refrigerant charge. The refrigeration system 400 or any component(s) thereof can be used with one or more other examples described elsewhere herein. Some aspects of the refrigeration system 400 are not shown for simplicity. For example, the refrigeration system 400 can include a control system and one or more sensors to manage refrigerant charge distribution between condenser loops based on whether an undercharge condition or an overcharge condition exists.

The refrigeration system 400 includes an evaporator 402 having its outlet coupled to an inlet of a compressor 404. The outlet of the compressor 404 is coupled to each of condenser loops 406-1, 406-2, . . . , 406-N, where N is an integer. That is, the refrigeration system 400 can include N number of condenser loops, and each of the condenser loops 406-1, 406-2, . . . , 406-N can include one or more condensers. The condenser loops can include respective inlet valves 408-1, 408-2, . . . , 408-N. The condenser loops can include respective redistribution valves 410-1, 410-2, . . . , 410-N. The refrigeration system 400 includes an expansion valve 412 positioned between the condenser loops 406-1, 406-2, . . . , 406-N and the inlet of the evaporator 402.

In operation, one or more of the condenser loops 406-1, 406-2, . . . , 406-N can be activated and be referred to as an active condenser loop. The remining one(s) of the condenser loops 406-1, 406-2, . . . , 406-N can be inactive and be referred to as an inactive condenser loop. In response to detection of an undercharge condition, one or more of the redistribution valves 410-1, 410-2, . . . , 410-N of the inactive condenser loop(s) can be opened. In response to detection of an overcharge condition, one or more of the inlet valves 408-1, 408-2, . . . , 408-N of the inactive condenser loop(s) can be opened at least partially.

Figure 5:
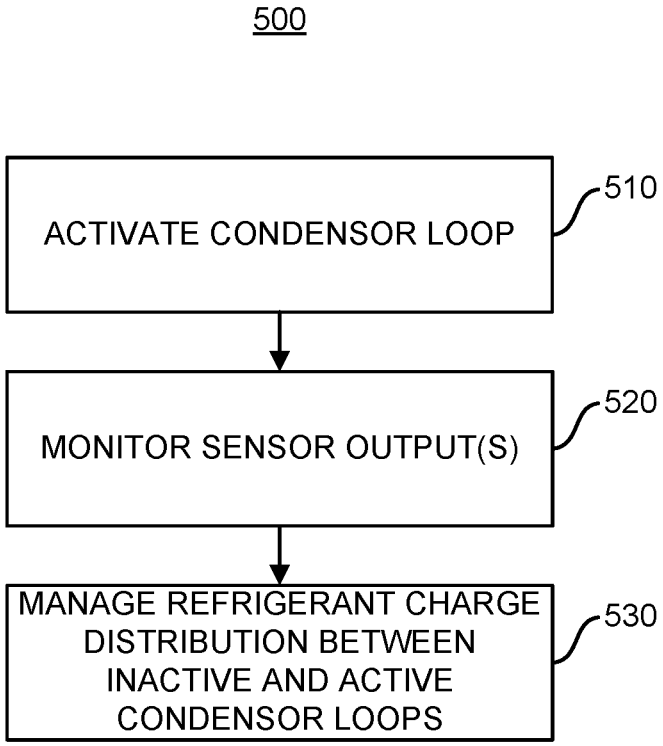
FIGS. 5-7 show flowcharts with examples of methods.
Figure 6:
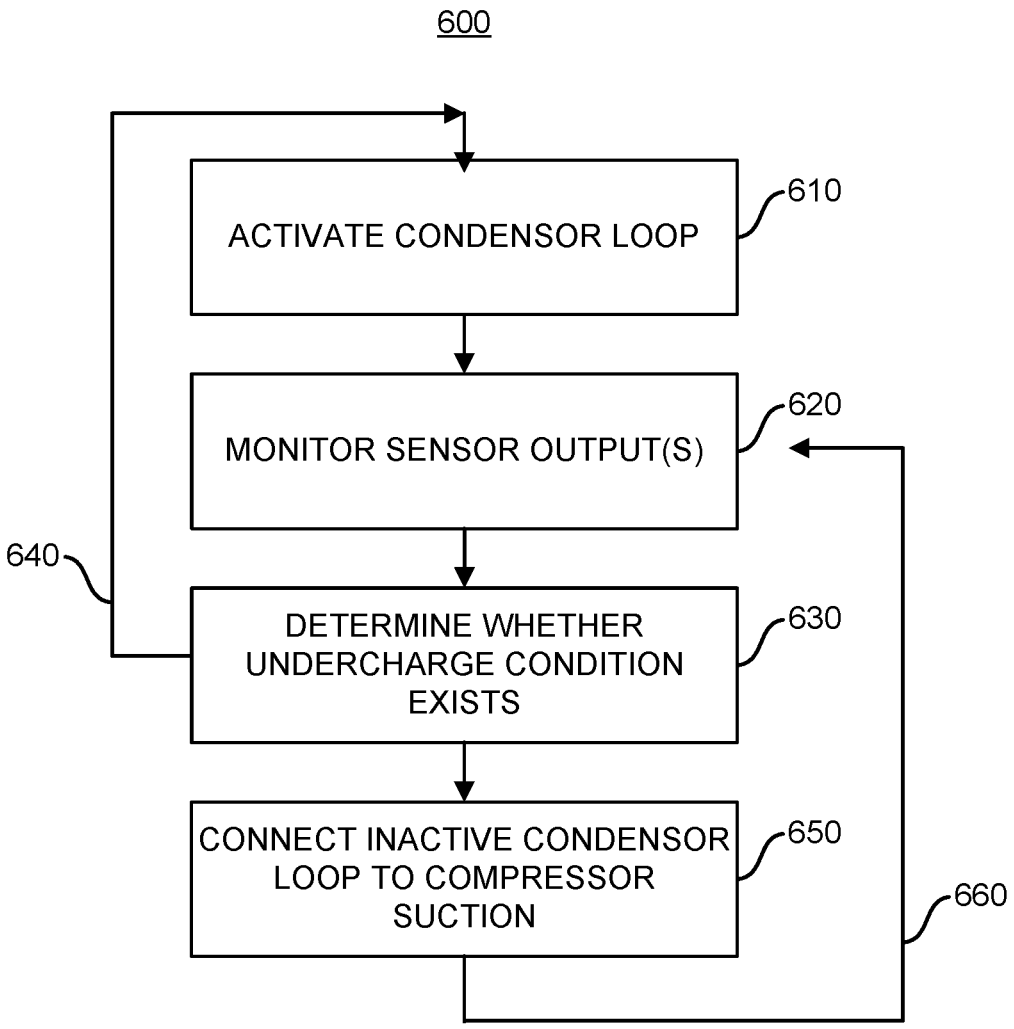
Figure 7:
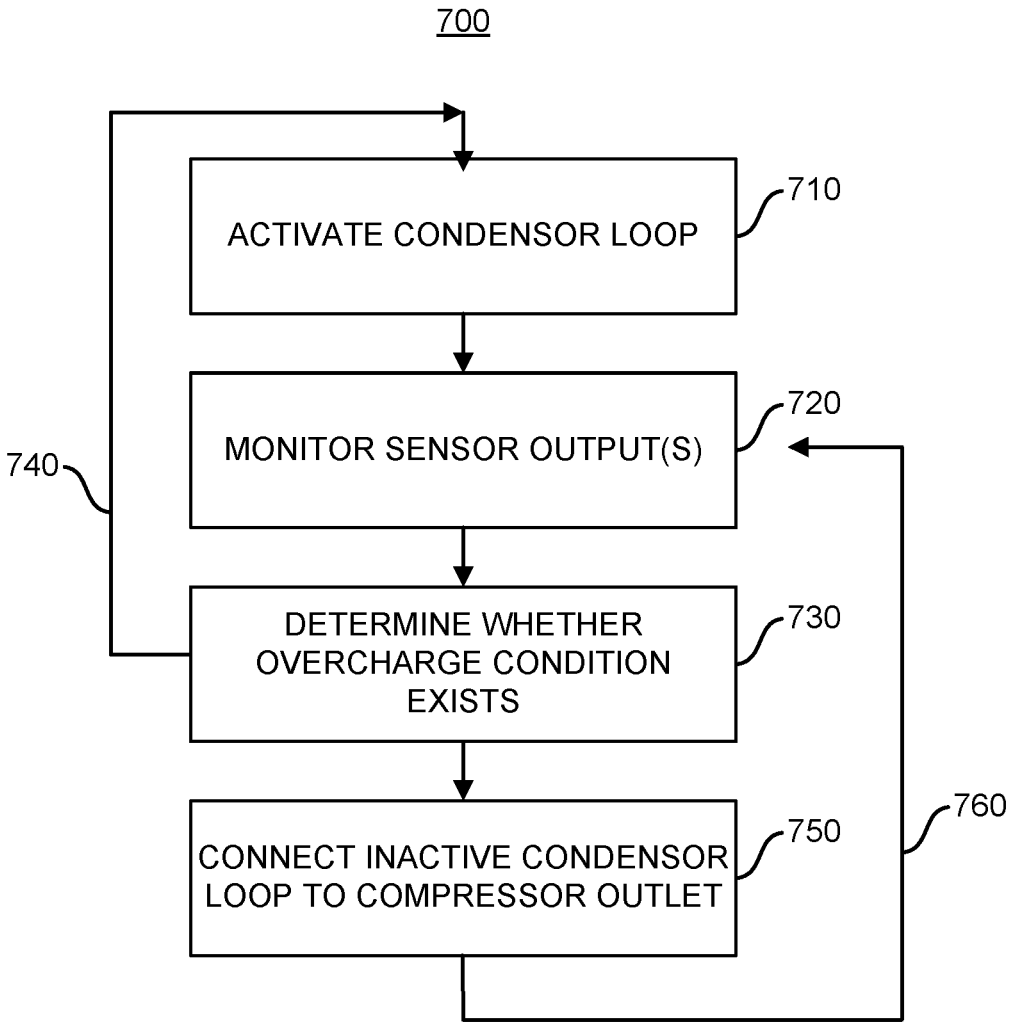

FIGS. 5-7 show flowcharts with examples of methods 500, 600, and 700, respectively. The methods 500, 600, or 700 can be used with one or more other examples described elsewhere herein. More or fewer operations than shown can be performed. Two or more operations can be performed in a different order unless otherwise indicated.

In the method 500, operation 510 involves activating a first condenser loop in a refrigeration system, wherein a second condenser loop is presently not active. For example, the condenser loop 101 or 102 in FIG. 1 can be activated.

Operation 520 involves monitoring sensor output in the refrigeration system indicating whether an undercharge condition or an overcharge condition exists in the refrigeration system. For example, a control system can use output of the sensor 140, 142, and/or 144 in FIG. 1.

Operation 530 involves managing refrigerant charge distribution between the first and second condenser loops based on whether the undercharge condition or the overcharge condition exists in the refrigeration system. For example, one or more of the redistribution valves 126, 128, 130, or 138 in FIG. 1 can be at least partially opened. As another example, one or more of the inlet valves 114 or 132 in FIG. 1 can be at least partially opened.

The method 500 can be performed while the refrigeration system is operating in any of multiple modes. In some implementations, the refrigeration can be operating in a cooling mode. Such a cooling mode can involve that the inlet valve of the active condenser loop is open. At the beginning of the cooling mode operation, some valve(s) of the inactive condenser loop(s) can temporarily be opened. For example, the inlet valve, outlet valve, and redistribution valve can be temporarily opened.

In some implementations, the refrigeration can be operating in a heating mode. Such a heating mode can involve that the inlet valve of the active condenser loop is open. In the cooling mode operation, some valve(s) of the inactive condenser loop(s) can be open. For example, the inlet valve and the outlet valve can be open.

In the heating mode, valves can be configured to accomplish a hot gas loop. In this mode, power consumed by compressor will be the main source of providing heat. For example, in refrigeration system 100, valves 132 and 136 will be open and valve 114 will be closed to activate condenser loop 102. Hot discharge gas from compressor will flow through condenser 134 and heat the secondary fluid that flows through/over the condenser. In evaporator(s), secondary fluid (air/water/coolant, etc.) will be bypassed to prevent heat extraction from the secondary fluid. Expansion valve(s) will be adjusted appropriately as fully/partially open to allow expansion of the cooled gas from condenser. Charge management routine can be performed as needed during the hot gas loop mode, similar to regular cooling or heating mode.

In some implementations, the refrigeration can be operating in a combined cooling and heating mode. In such a combined cooling and heating mode, in response to heat rejection through the active condenser loop exceeding a threshold, the control system can at least partially open one or more valves in the refrigeration system. For example, the inlet valve of the active condenser loop, the inlet valve of the inactive condenser loop, and/or the outlet valve of the inactive condenser loop can be at least partially opened. A goal may be to only provide the desired amount of heat rejection in the active condenser loop. This mode can be referred to as a proportioning mode.

Turning now to the method 600, an operation 610 involves activating a first condenser loop in a refrigeration system, wherein a second condenser loop is presently not active. For example, the condenser loop 101 or 102 in FIG. 1 can be activated.

Operation 620 involves monitoring sensor output in the refrigeration system indicating whether an undercharge condition or an overcharge condition exists in the refrigeration system. For example, a control system can use output of the sensor 140, 142, and/or 144 in FIG. 1.

Operation 630 involves determining whether an undercharge condition exists in the refrigeration system. If the undercharge condition does not currently exist, the method 600 can return to the operation 610 by a path 640, wherein the condenser loop(s) will continue to remain active.

If the undercharge condition does exist in operation 630, the method 600 can proceed to an operation 650 that involves connecting the inactive condenser loop(s) to compressor suction. For example, one or more redistribution valves can be used. The method 600 can return to the operation 620 by a path 660.

When or if the control system determines that the undercharge condition no longer exists in the refrigeration system, the path 640 can correspond to ceasing the refrigerant charge distribution management (e.g., by closing the redistribution valve(s)).

In the method 700, finally, an operation 710 involves activating a first condenser loop in a refrigeration system, wherein a second condenser loop is presently not active. For example, the condenser loop 101 or 102 in FIG. 1 can be activated.

Operation 720 involves monitoring sensor output in the refrigeration system indicating whether an undercharge condition or an overcharge condition exists in the refrigeration system. For example, a control system can use output of the sensor 140, 142, and/or 144 in FIG. 1.

Operation 730 involves determining whether an overcharge condition exists in the refrigeration system. If the overcharge condition does not currently exist, the method 700 can return to the operation 710 by a path 740, wherein the condenser loop(s) will continue to remain active.

If the overcharge condition does exist in operation 730, the method 700 can proceed to an operation 750 that involves connecting the inactive condenser loop(s) to the active condenser loop(s). For example, one or more inlet valves can be used. The method 700 can return to the operation 720 by a path 760.

When or if the control system determines that the overcharge condition no longer exists in the refrigeration system, the path 740 can correspond to ceasing the refrigerant charge distribution management (e.g., by closing the inlet valve(s)).

The terms "substantially" and "about" used throughout this Specification are used to describe and account for small fluctuations, such as due to variations in processing. For example, they can refer to less than or equal to ±5%, such as less than or equal to ±2%, such as less than or equal to ±1%, such as less than or equal to ±0.5%, such as less than or equal to ±0.2%, such as less than or equal to ±0.1%, such as less than or equal to ±0.05%. Also, when used herein, an indefinite article such as "a" or "an" means "at least one."

It should be appreciated that all combinations of the foregoing concepts and additional concepts discussed in greater detail below (provided such concepts are not mutually inconsistent) are contemplated as being part of the inventive subject matter disclosed herein. In particular, all combinations of claimed subject matter appearing at the end of this disclosure are contemplated as being part of the inventive subject matter disclosed herein.

A number of implementations have been described. Nevertheless, it will be understood that various modifications may be made without departing from the spirit and scope of the specification.

In addition, the logic flows depicted in the figures do not require the particular order shown, or sequential order, to achieve desirable results. In addition, other processes may be provided, or processes may be eliminated, from the described flows, and other components may be added to, or removed from, the described systems. Accordingly, other implementations are within the scope of the following claims.

While certain features of the described implementations have been illustrated as described herein, many modifications, substitutions, changes and equivalents will now occur to those skilled in the art. It is, therefore, to be understood that appended claims are intended to cover all such modifications and changes as fall within the scope of the implementations. It should be understood that they have been presented by way of example only, not limitation, and various changes in form and details may be made. Any portion of the apparatus and/or methods described herein may be combined in any combination, except mutually exclusive combinations. The implementations described herein can include various combinations and/or sub-combinations of the functions, components and/or features of the different implementations described.

What is claimed is:

1. A refrigeration system comprising:

an evaporator having an evaporator inlet and an evaporator outlet;

a compressor having (i) a compressor outlet, and (ii) a compressor inlet coupled to the evaporator outlet;

a first condenser loop coupled between the compressor outlet and the evaporator inlet, the first condenser loop comprising: a first inlet valve, a first condenser, and a first redistribution valve positioned before the first condenser in a direction of flow in the first condenser loop, the first redistribution valve coupling the first condenser loop directly to the compressor inlet; and a second condenser loop coupled between the compressor outlet and the evaporator inlet, the second condenser loop comprising: a second inlet valve, a second condenser, and a second redistribution valve positioned before the second condenser in a direction of flow in the second condenser loop, the second redistribution valve coupling the second condenser loop directly to the compressor inlet.

2. The refrigeration system of claim 1, wherein the first redistribution valve couples a point on the first condenser loop before the first condenser to the compressor inlet.

3. The refrigeration system of claim 1, wherein the first condenser loop further comprises a third condenser.

4. The refrigeration system of claim 3, wherein the third condenser and the first condenser are coupled in series in the first condenser loop.

5. The refrigeration system of claim 4, wherein the first redistribution valve couples a point on the first condenser loop between the third condenser and the first condenser to the compressor inlet.

6. The refrigeration system of claim 5, further comprising a third redistribution valve that couples a point on the first condenser loop after the first and third condensers to the compressor inlet.

7. The refrigeration system of claim 1, wherein the first redistribution valve couples a point on the first condenser loop after the first condenser to the compressor inlet.

8. The refrigeration system of claim 1, further comprising a third condenser loop coupled between the compressor outlet and the evaporator inlet, the third condenser loop comprising: a third inlet valve, a third condenser, and a third redistribution valve coupling the third condenser loop to the compressor inlet.

9. A refrigeration system comprising:

an evaporator having an evaporator inlet and an evaporator outlet;

a compressor having (i) a compressor outlet, and (ii) a compressor inlet coupled to the evaporator outlet;

a first condenser loop coupled between the compressor outlet and the evaporator inlet, the first condenser loop comprising: a first inlet valve, a first condenser, and a first redistribution valve coupling the first condenser loop to the compressor inlet; and a second condenser loop coupled between the compressor outlet and the evaporator inlet, the second condenser loop comprising: a second inlet valve, a second condenser, and a second redistribution valve coupling the second condenser loop to the compressor inlet;

wherein the first condenser loop further comprises a third condenser, and wherein the third condenser and the first condenser are coupled in parallel in the first condenser loop.

10. The refrigeration system of claim 9, wherein the first redistribution valve couples a point on the first condenser loop before the first and third condensers to the compressor inlet.

11. The refrigeration system of claim 9, further comprising a third redistribution valve that couples a point on the first condenser loop after the first and third condensers to the compressor inlet.

12. A refrigeration system comprising:

an evaporator having an evaporator inlet and an evaporator outlet;

a compressor having (i) a compressor outlet, and (ii) a compressor inlet coupled to the evaporator outlet;

a first condenser loop coupled between the compressor outlet and the evaporator inlet, the first condenser loop comprising: a first inlet valve, a first condenser, and a first redistribution valve coupling the first condenser loop to the compressor inlet;

a second condenser loop coupled between the compressor outlet and the evaporator inlet, the second condenser loop comprising: a second inlet valve, a second condenser, and a second redistribution valve coupling the second condenser loop to the compressor inlet; and a sensor to detect an undercharge condition or an overcharge condition in the refrigeration system.

13. A method comprising:

activating a first condenser loop in a refrigeration system, wherein a second condenser loop is presently not active;

monitoring sensor output in the refrigeration system indicating whether an undercharge condition or an overcharge condition exists in the refrigeration system; and managing refrigerant charge distribution between the first and second condenser loops based on whether the undercharge condition or the overcharge condition exists in the refrigeration system.

14. The method of claim 13, wherein monitoring the sensor output for whether the undercharge condition exists in the refrigeration system comprises monitoring at least one of evaporator outlet pressure, evaporator outlet temperature, or opening of expansion valve coupled to an inlet of an evaporator in the refrigeration system.

15. The method of claim 13, wherein, in response to the sensor output indicating that the undercharge condition exists in the refrigeration system, managing the refrigerant charge distribution comprises opening a redistribution valve of the second condenser loop.

16. The method of claim 15, wherein, in response to the sensor output indicating that the undercharge condition exists in the refrigeration system, managing the refrigerant charge distribution further comprises opening an inlet valve of the second condenser loop.

17. The method of claim 13, wherein monitoring the sensor output for whether the overcharge condition exists in the refrigeration system comprises monitoring at least one of subcooling, compressor discharge pressure, or suction superheat.

18. The method of claim 17, wherein subcooling is monitored, and wherein monitoring subcooling comprises detecting pressure and temperature at an evaporator outlet in the refrigeration system.

19. The method of claim 13, wherein, in response to the sensor output indicating that the overcharge condition exists in the refrigeration system, managing the refrigerant charge distribution comprises opening a redistribution valve of the second condenser loop.

20. The method of claim 19, wherein, in response to the sensor output indicating that the overcharge condition exists in the refrigeration system, managing the refrigerant charge distribution further comprises activating a heat-removing mechanism of the second condenser loop.

21. The method of claim 13, wherein the activation of the first condenser loop, the monitoring of the sensor output, and the management of the refrigerant charge distribution are performed while the refrigeration system is operating in a cooling mode.

22. The method of claim 21, wherein the cooling mode comprises that a first inlet valve of the first condenser loop is open, the method further comprising, at a beginning of the cooling mode, temporarily opening a second inlet valve of the second condenser loop, an outlet valve of the second condenser loop, and a redistribution valve of the second condenser loop.

23. The method of claim 13, wherein the activation of the first condenser loop, the monitoring of the sensor output, and the management of the refrigerant charge distribution are performed while the refrigeration system is operating in a heating mode.

24. The method of claim 23, wherein the heating mode comprises that a second inlet valve of the second condenser loop, and an outlet valve of the second condenser loop, are open.

25. The method of claim 13, wherein the activation of the first condenser loop, the monitoring of the sensor output, and the management of the refrigerant charge distribution are performed while the refrigeration system is operating in a combined cooling and heating mode.

26. The method of claim 25, further comprising, in response to heat rejection through the first condenser loop exceeding a threshold, at least partially opening each of: (i) a first inlet valve of the first condenser loop, (ii) a second inlet valve of the second condenser loop, and (iii) an outlet valve of the second condenser loop.

* * * * *